US009124967B2

(12) United States Patent
Morton

(10) Patent No.: US 9,124,967 B2
(45) Date of Patent: Sep. 1, 2015

(54) MICROPHONE SYSTEMS FOR BASE DRUMS AND OTHER INSTRUMENTS

(71) Applicant: Terrance Marshall Morton, San Rafael, CA (US)

(72) Inventor: Terrance Marshall Morton, San Rafael, CA (US)

( * ) Notice: Subject to any disclaimer, the term of this patent is extended or adjusted under 35 U.S.C. 154(b) by 328 days.

(21) Appl. No.: 13/844,694

(22) Filed: Mar. 15, 2013

(65) Prior Publication Data

US 2014/0086443 A1 Mar. 27, 2014

Related U.S. Application Data

(60) Provisional application No. 61/705,974, filed on Sep. 26, 2012.

(51) Int. Cl.

| | |
|---|---|
| ***G10H 1/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/02*** | (2006.01) |
| ***G10H 3/14*** | (2006.01) |
| ***H04R 1/08*** | (2006.01) |

(52) U.S. Cl.

CPC ..... *H04R 1/02* (2013.01); *G10H 3/146* (2013.01); *H04R 1/083* (2013.01); *H04R 2410/00* (2013.01)

(58) Field of Classification Search

CPC ..... G10H 3/146; H04R 1/02; H04R 1/083; H04R 2410/00

USPC ..... 381/355, 361

See application file for complete search history.

(56) References Cited

U.S. PATENT DOCUMENTS

| | | | | |
|---|---|---|---|---|
| 3,612,783 | A * | 10/1971 | Schneider | 381/404 |
| 3,958,275 | A * | 5/1976 | Morgan et al. | 2/421 |
| 4,581,972 | A * | 4/1986 | Hoshino | 84/723 |
| 4,975,966 | A * | 12/1990 | Sapiejewski | 381/189 |
| 7,525,039 | B2 | 4/2009 | Steele | |
| 7,723,596 | B2 | 5/2010 | Kelly | |
| 7,968,780 | B2 | 6/2011 | Millender et al. | |
| 8,039,724 | B1 * | 10/2011 | Norman et al. | 84/743 |
| 8,170,258 | B1 | 5/2012 | Wells | |
| 8,338,681 | B2 | 12/2012 | Mollick | |
| 2002/0181715 | A1 * | 12/2002 | Kang | 381/71.5 |
| 2004/0008101 | A1 * | 1/2004 | Trandafir | 335/229 |
| 2006/0050917 | A1 * | 3/2006 | Skillicorn et al. | 381/384 |
| 2006/0182301 | A1 * | 8/2006 | Medveczky | 381/362 |
| 2008/0227073 | A1 * | 9/2008 | Bardsley et al. | 434/267 |
| 2009/0071318 | A1 * | 3/2009 | Miniaev | 84/731 |
| 2010/0031806 | A1 * | 2/2010 | Gaynier | 84/723 |
| 2010/0066121 | A1 * | 3/2010 | Gross | 296/146.5 |
| 2010/0239109 | A1 * | 9/2010 | Lutz et al. | 381/190 |
| 2010/0284545 | A1 * | 11/2010 | Dietz | 381/58 |
| 2011/0299716 | A1 * | 12/2011 | Reckert | 381/398 |
| 2012/0051570 | A1 * | 3/2012 | Arche | 381/315 |

* cited by examiner

*Primary Examiner* — Khai N Nguyen

(74) *Attorney, Agent, or Firm* — Steven A. Nielsen; www.NielsenPatents.com

(57) ABSTRACT

A microphone system and microphone mount system integrate upon and into a drum head to efficiently capture various drum sounds. An attachment ring 170 is attached to the perimeter of a void within a drum head. A slide bracket slides 160 into the attachment ring 170. The slide bracket 160 is secured to and is part of a microphone assembly 100. The microphone assembly accommodates flexible goose necks 200 that hold microphone clip adapters to secure additional microphones both interior and exterior to a drum head 300.

15 Claims, 17 Drawing Sheets

Prior
Art

MICROPHONE SYSTEMS FOR BASE DRUMS AND OTHER INSTRUMENTS

RELATED PATENT APPLICATION AND INCORPORATION BY REFERENCE

This is a utility application based upon U.S. patent application Ser. No. 61/705,974 filed on Sep. 26, 2012. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION (1) Field of the Invention

The invention generally relates to microphone systems. More particularly, the invention relates to systems and methods of improved sound capture within and near a drum or other instrument.

(2) Description of the Related Art

U.S. Pat. No. 7,525,039 by Steele discloses an electronic bass drum comprising loud speakers, an internal amplifier system and other components. U.S. Pat. No. 7,723,596 by Kelly discloses an internal microphone support system allowing a standard microphone to be placed within a drum. Kelly uses a plurality of hanger members and connector members. U.S. Pat. No. 7.968,780 by Millender et al discloses an insert for a double membrane drum in an effort to change the tonal qualities of the drum. U.S. Pat. No. 8,170,258 by Wells discloses a support bar system placed within a drum to support a microphone.

The prior art presents several shortfalls in that complicated and cumbersome components are used to alter the sound of a drum or to secure a microphone within a drum. Such prior art solutions are not well suited for the rigors of road tours or for drummers of limited means. The prior art solutions also fail to capture the true tonal qualities generated by high end drums. Thus, there is a need in the art for the presently disclosed embodiments.

BRIEF SUMMARY OF THE INVENTION

The present invention overcomes shortfalls in the related art by presenting an unobvious and unique combination, configuration and use of mounting and microphone components to efficiently capture drum sound found within a drum and outside of a drum.

Disclosed embodiments use a compact microphone assembly that easily attaches to an attachment ring. The attachment ring is secured at the perimeter of a circular void found upon a drum head or resonant membrane. With the advent of various new port systems, circular voids within drum heads are becoming more common in the percussion field; however, the prior art fails to leverage such voids to improve microphone performance or to artfully secure microphones.

Disclosed embodiments achieve unexpectedly excellent results in capturing smooth frequency responses as compared to the prior art. For example, disclosed embodiments achieve remarkable results in capturing sound in the range of 47 Hz, as shown in FIG. 13 below. Disclosed microphone assemblies use an artful combination of components which comprise hemp cones, speaker covers with voids, neodymium magnets, foam spacers, slide brackets, and O rings and foam rings attached to attachment rings.

Disclosed embodiments overcome the shortfalls in the art by providing efficient, artful and integrated goose necks to secure additional microphones near a beater or other implement striking a drum head and to secure additional microphones within a drum enclosure. Unlike the prior art, disclosed microphone attachment systems do not add bulk to a drum kit.

REFERENCE NUMERALS IN THE DRAWINGS

Figure 1:
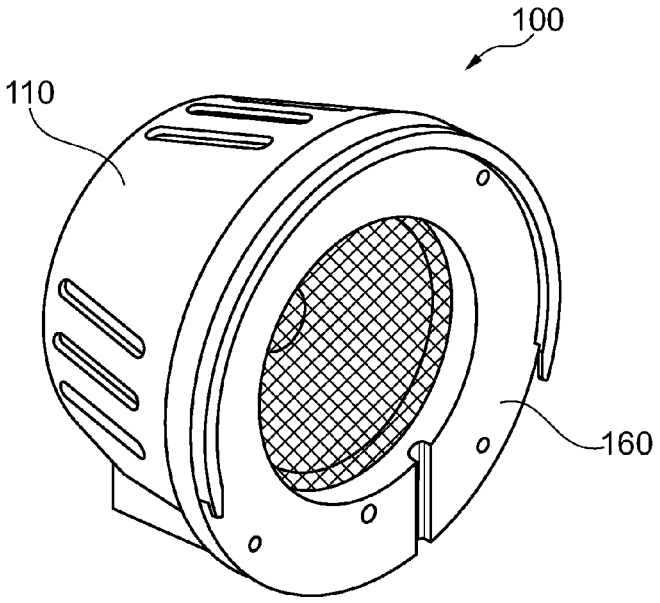
FIG. 1 depicts a perspective view of a microphone assembly

100 a microphone assembly
110 speaker cover
112 voids in speaker cover 110
115 XLR jack location
120 speaker frame
125 speaker voice coil and spider area
130 magnet, sometimes a neodymium magnet
140 speaker cone, sometimes a hemp cone
150 foam spacer, with optional closed cells

155 mesh screen
160 slide bracket
161 shelf of slide bracket
162 channel for XLR cable
163 attachment voids of slide bracket
164 void within slide bracket, void used for goose neck attachment
165 inner circumference of slide bracket
166 outer circumference of slide bracket
167 containment pocket of slide bracket
170 attachment ring
172 foam member of attachment ring, with optional closed cells
173 drum head O ring
174 insertion portion of attachment ring
175 inner wall of attachment ring
176 top side of foam member 174, the top side sometimes attached to a drum head
200 flexible goose neck
210 microphone clip adapter female to male
220 microphone clip adapter male to male
300 drum head or resonant membrane
310 void of drum head
400 inner pocket floor of slide bracket
401 vertical outer wall is slide bracket
402 top wall of slide bracket
403 top face of slide bracket
404 inner floor of containment pocket 167
500 a smooth frequency response in the area of 47 Hz obtained with the disclosed embodiments
600 an uneven frequency response in the area of 47 Hz obtained with prior art methods These and other aspects of the present invention will become apparent upon reading the following detailed description in conjunction with the associated drawings.

Detailed Description Of Embodiments Of The Invention

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts an assembled microphone assembly 100 in a front and side perspective view. A slide bracket is shown in the foreground and a speaker cover is shown in the background.

Figure 2:
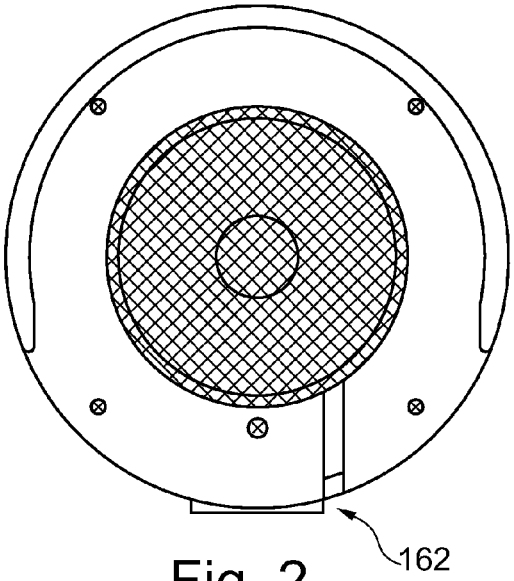
FIG. 2 depicts a front view of a microphone assembly

FIG. 2 depicts a top plan view of a microphone assembly 100. The slide bracket is shown with a channel 162 sometimes used with an XLR cable.

Figure 3:
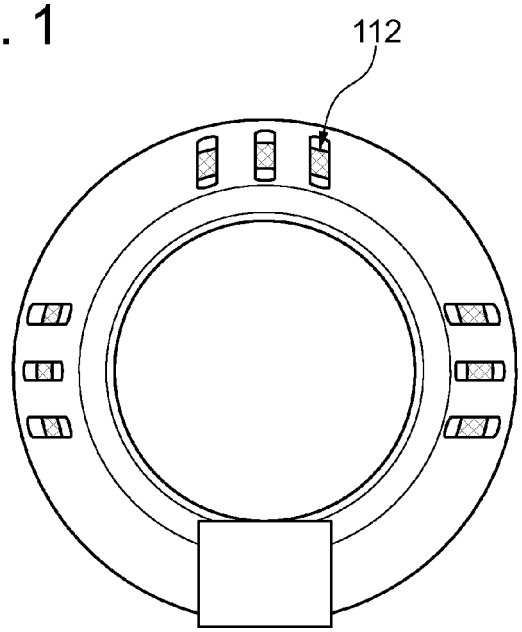
FIG. 3 depicts a rear view of a microphone assembly

FIG. 3 is a back plan view, showing a speaker cover having voids 112.

Figure 4:
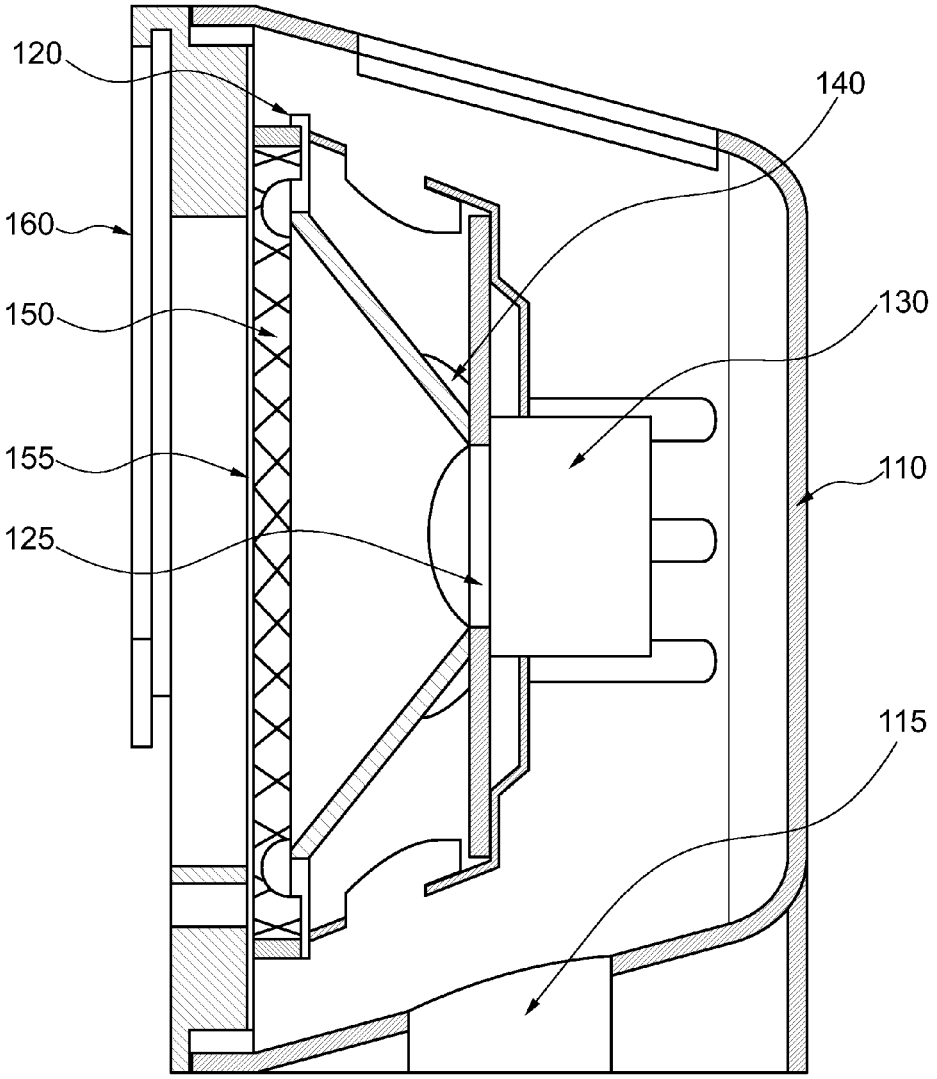
FIG. 4 depicts components of a microphone assembly

FIG. 4 is a section view of a microphone assembly 100 comprising a speaker cover 110, voids 112 in the speaker cover, a magnet 130, the magnet sometimes a neodymium magnet, a speaker or microphone cone 140, the cone sometimes made of hemp, a speaker or microphone frame 120, a voice coil 125 and spider, a foam spacer 150, a mesh screen 155 and a slide bracket. The use of foam spacer has been shown to improve the quality of captured sound.

Figure 5:
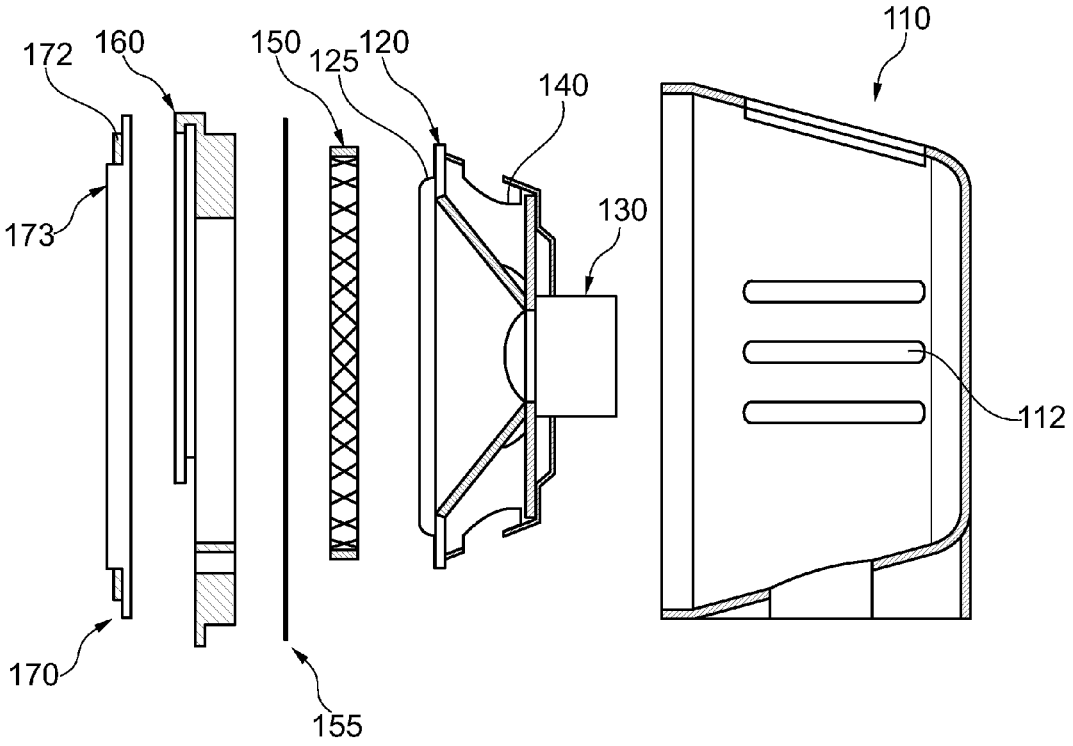
FIG. 5 depicts components of a microphone assembly in an exploded view

FIG. 5 shows an expanded or exploded view of a microphone assembly 100 comprising a speaker cover 110, voids 112 in the speaker cover, a magnet 130, the magnet sometimes a neodymium magnet, a speaker or microphone cone 140, the cone sometimes made of hemp, a speaker or microphone frame 120, a voice coil 125 and spider, a foam spacer 150, a mesh screen 155 and a slide bracket 160. Next to the slide bracket an attachment ring 170 is shown with a foam member 172 and an O ring.

Figure 6:
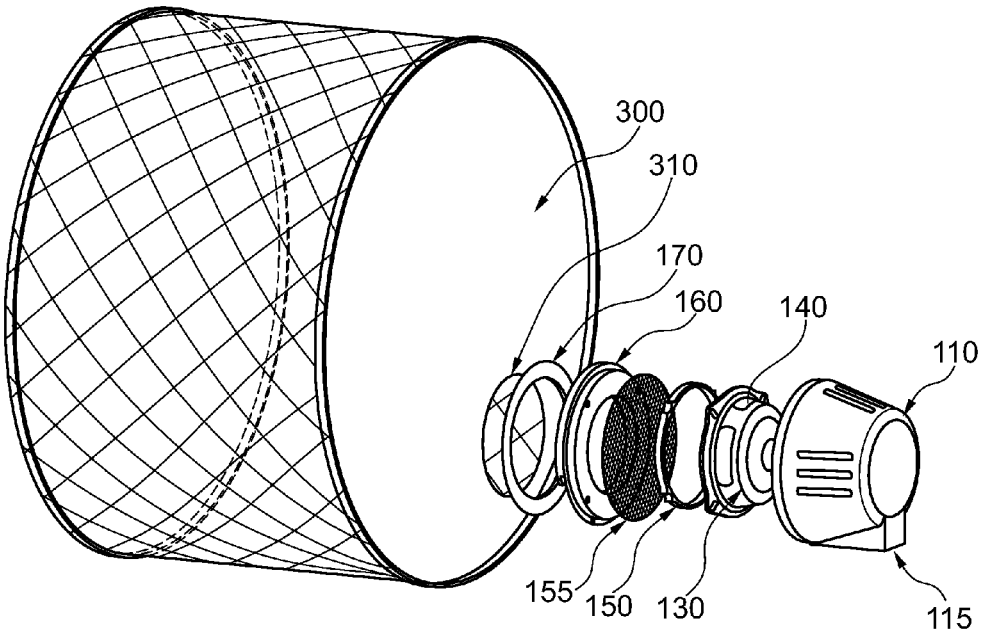
FIG. 6 depicts components of a microphone assembly and a drum

FIG. 6 depicts a drum having a drum head 300 or resonant membrane having a void 310. A foam member 172 may be attached to the drum head by use of adhesive and the foam member may be attached to an attachment ring 170. A slide bracket 160 may slide over the attachment ring, with the attachment ring securing the slide bracket 160 to the drum head 300. The slide bracket 160 may have attachment voids 163 allowing fasteners to attach the slide bracket to the speaker or microphone cover. Sandwiched between the slide bracket 160 and the speaker cover 115 is the mesh screen, foam spacer 150, magnet 130, speaker cone and speaker frame.

Figure 7:
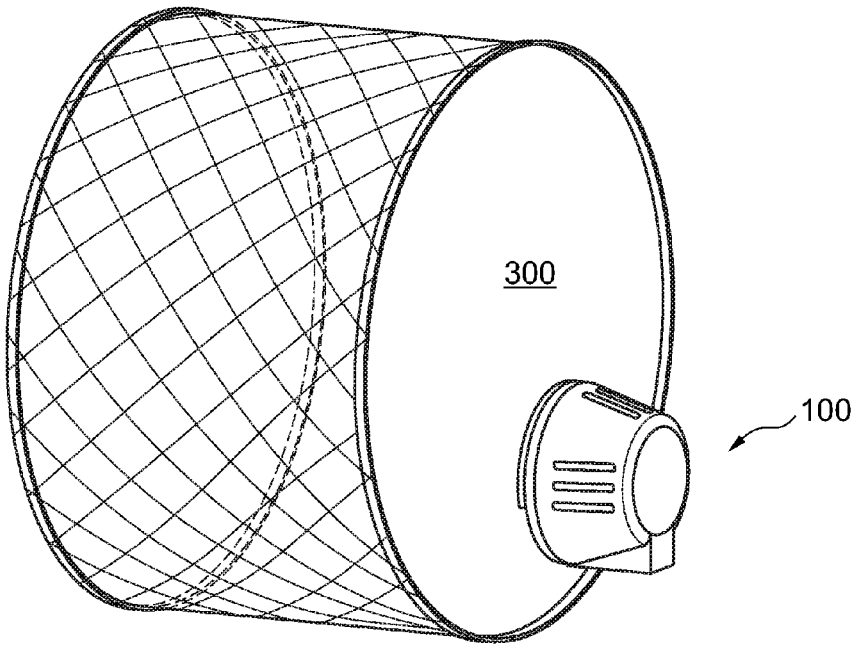
FIG. 7 depicts a microphone assembly and a drum

FIG. 7 depicts a microphone assembly 100 attached to a drum head 300. FIG. 7 shows the disclosed microphone assembly 100 to be an efficient attachment to the drum, in stark contrast to the prior art where complicated and awkward support members are used.

Figure 8:
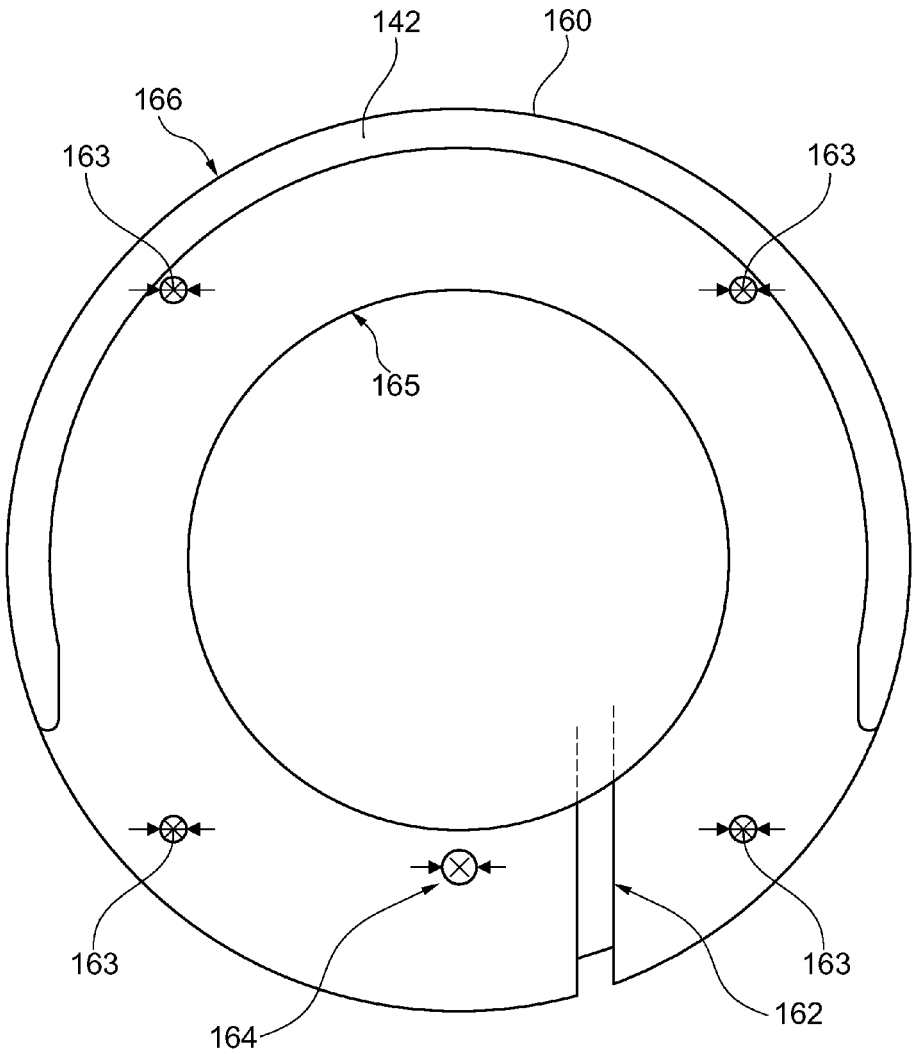
FIG. 8 depicts a front side of a slide bracket

FIG. 8 depicts a face of the slide bracket 160 that faces the drum head or void in the drum. The slide bracket is shown with a channel 162 sometimes used with a XLR cable. The slide bracket 160 is also shown with a plurality of attachment voids 163. The slide bracket is also shown with a void 164 used to retain a goose neck microphone attachment. The slide bracket has an outer circumference 166 and inner circumference 165. The top wall 142 of the slide bracket is shown over the channel 162 void.

Figure 9:
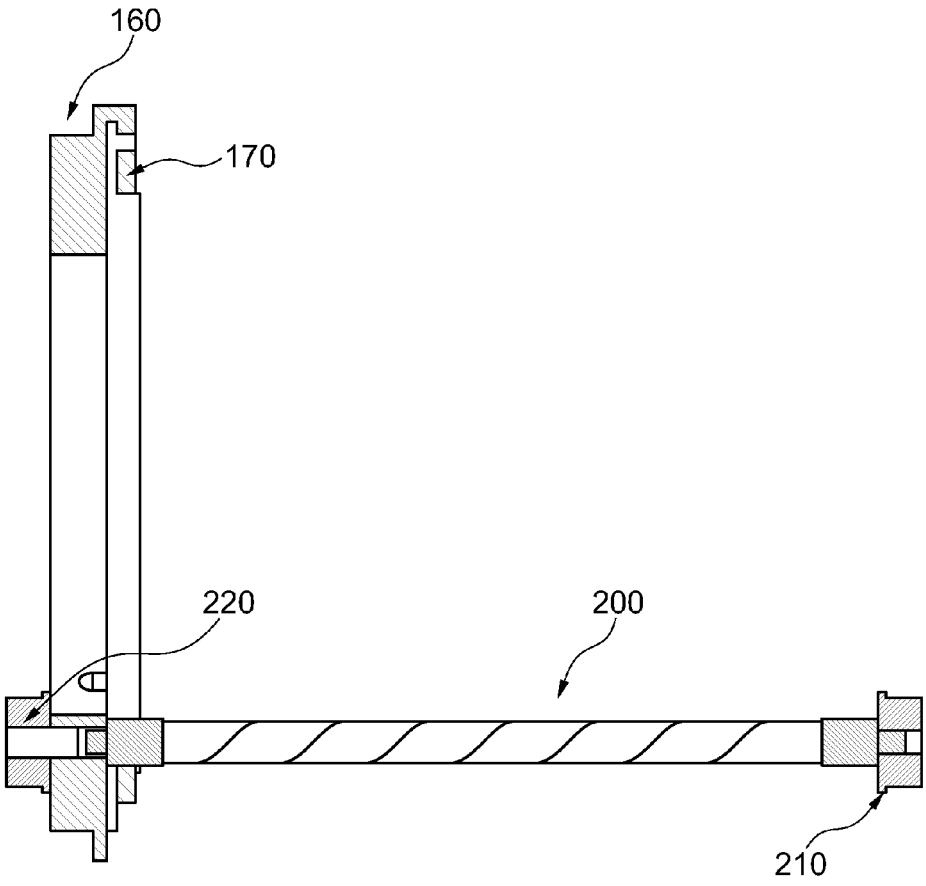
FIG. 9 depicts a section view of a slide bracket with a microphone goose neck

FIG. 9 depicts a flexible goose neck 200 in attachment with the slide bracket via the slide bracket's void 164 just adjacent to the channel 162. For the interior of a drum or other instrument the goose neck extends inwardly and is capped with a microphone clip 210 adapter having a female to male configuration.

Figure 10:
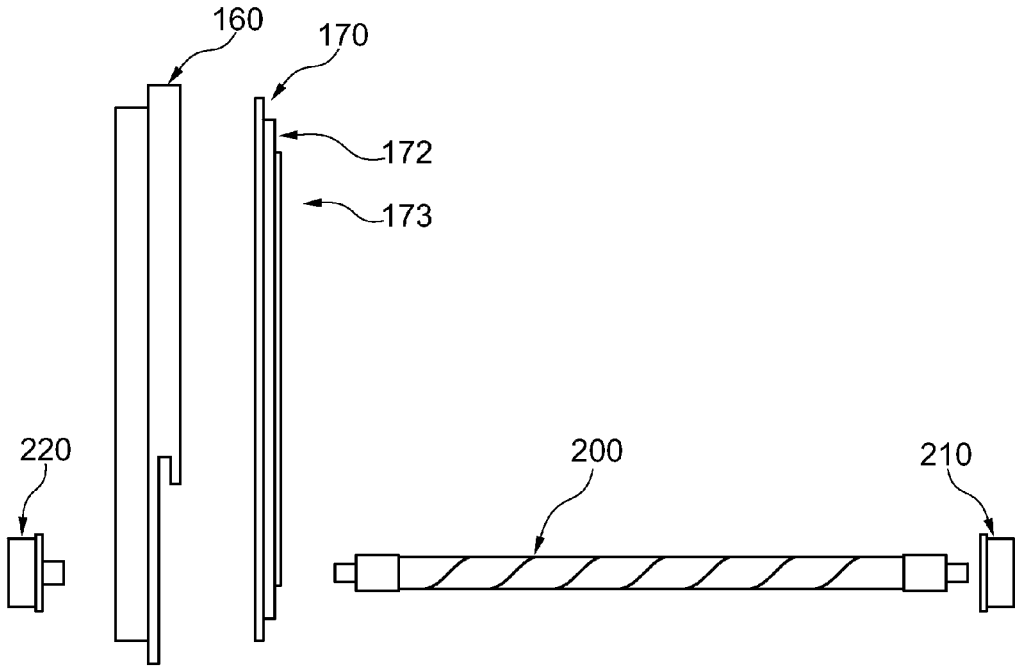
FIG. 10 depicts an exploded view of a slide bracket with a microphone goose neck

FIG. 10 is an exploded depiction of FIG. 9 and points out the attachment ring, foam member 172 and O ring 173

Figure 11:
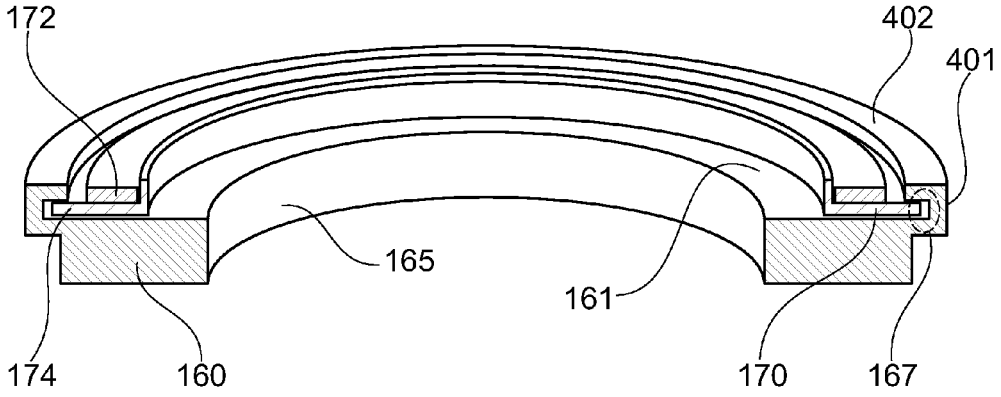
FIG. 11 depicts a sectional view of a slide ring and attachment ring

FIG. 11 depicts a slide bracket 160 mated to an attachment ring 170 with the attachment ring secured to a foam member 172. The attachment ring protrudes into a containment pocket 167 of the slide bracket. The attachment ring rests upon a shelf 161 of the slide bracket. The slide bracket is shown with a top wall 402 and a vertical outer wall 401. In general, the foam member 172 is glued or otherwise attached to a drum head and the attachment ring. The foam properties of the foam member help to increase the quality of recorded or captured sound. The attachment ring is shown with a insertion portion 174 that attaches within the containment pocket 167.

Figure 12:
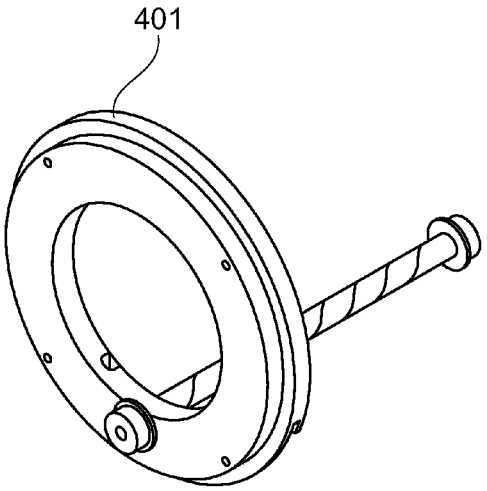
FIG. 12 depicts a front view of a slide ring with a microphone goose
Figure 13:
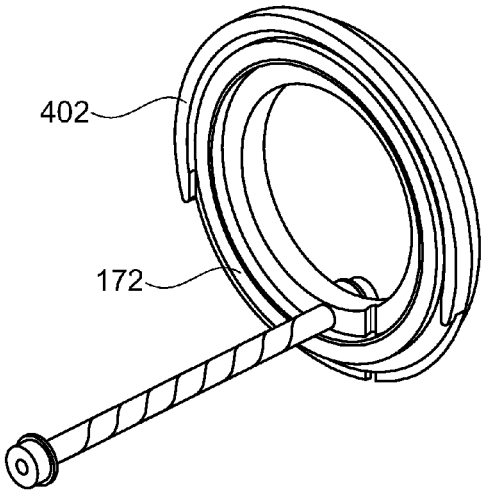
FIG. 13 depicts a back view of an slide ring with a microphone goose

FIG. 12 depicts a front view of a slide ring with a microphone goose with the microphone goose in position to extend into a drum. Both ends of the microphone goose 200 are shown with microphone clips. FIG. 13 presents a back view of FIG. 12.

Figure 14:
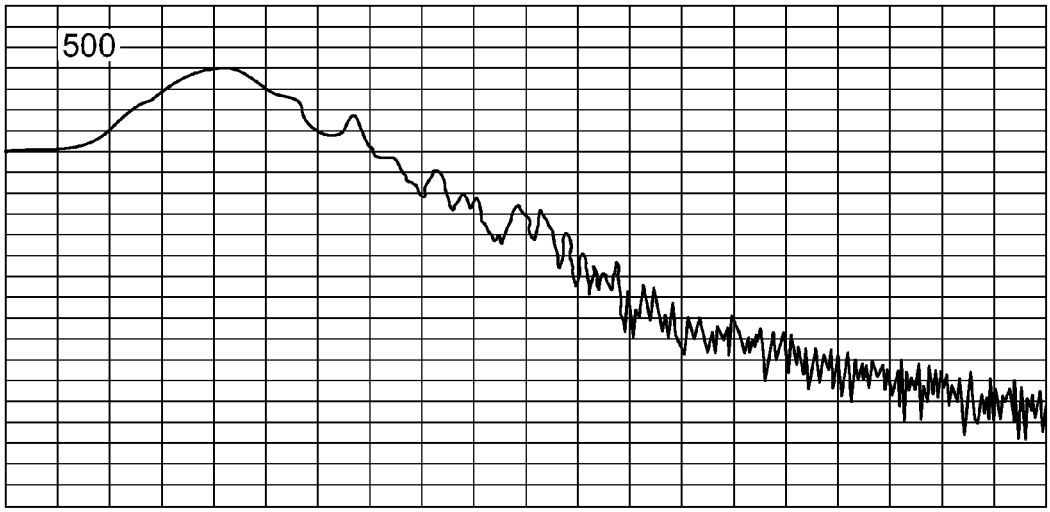
FIG. 14 depicts a frequency response chart

FIG. 14 presents a sound graph showing the superior sound capture of the disclosed embodiments. The sound graph of FIG. 14 was obtained with a 22 inch bass drum equipped with a disclosed microphone assembly. A very smooth frequency response was obtained in the range of 47 Hz.

Figure 15:
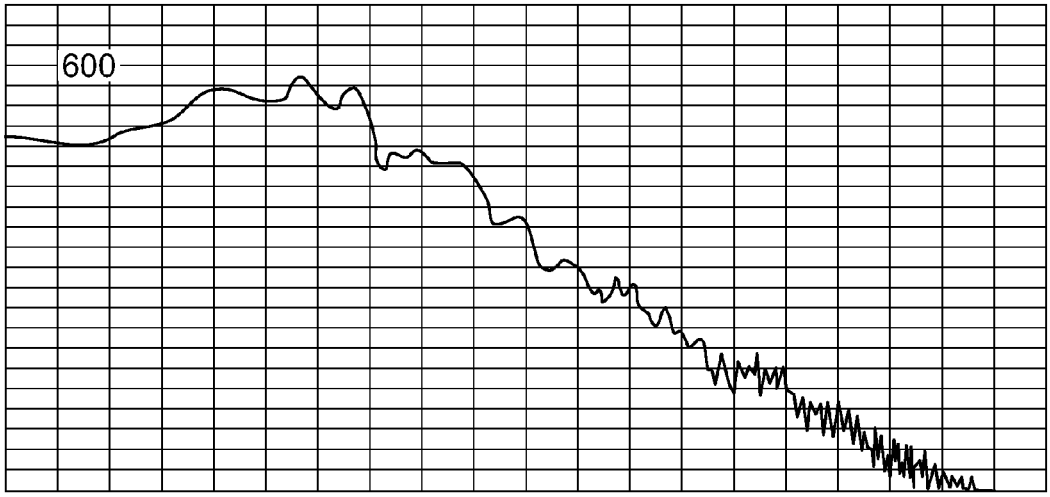
Fig. 15 Prior Art
FIG. 15 depicts a frequency response chart of a prior art device

FIG. 15 presents the inferior sound capture qualities of the prior art. The same 22 inch bass drum was used and the frequency response was uneven, a common shortfall in the prior art.

Figure 16:
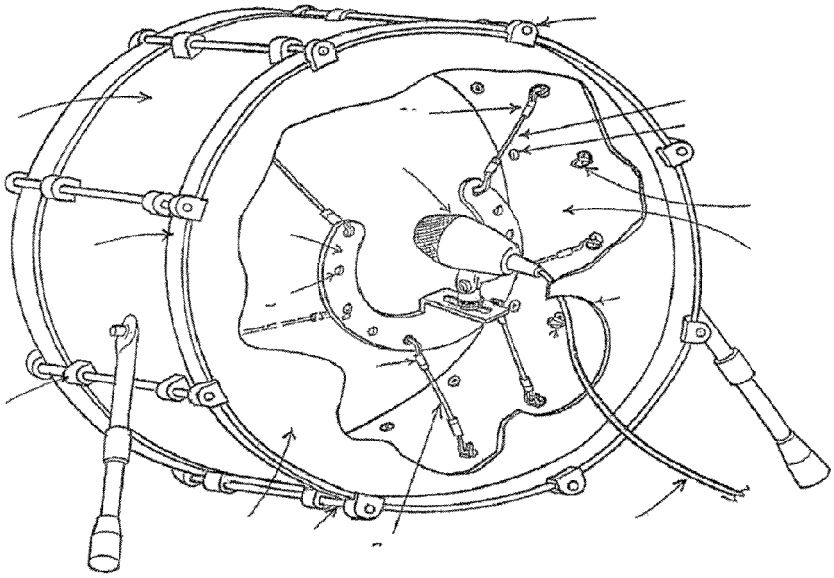
Fig. 16 Prior Art
FIG. 16 depicts a microphone system of the prior art

FIG. 16 presents a prior art microphone method of the Kelly patent discussed above. The complexity and inefficiency of the Kelly system has many faults, including the need to add extra voids into a drum head.

Figure 17:
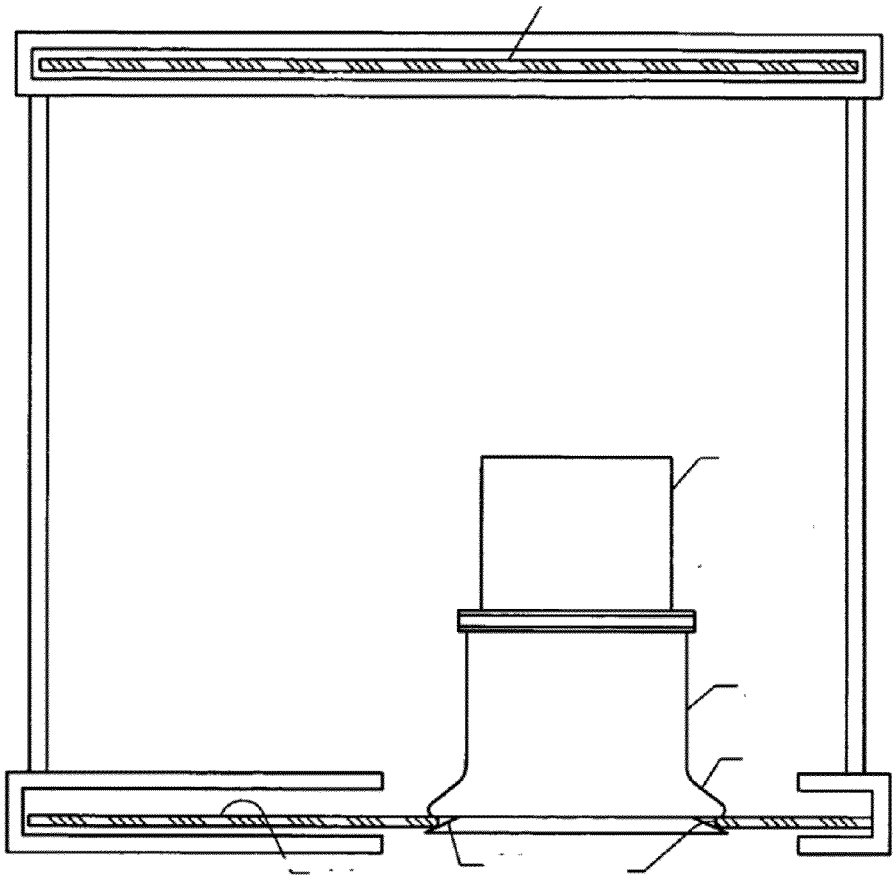
Fig. 17 Prior Art
FIG. 17 depicts a drum insert of the prior art

FIG. 17 depicts an insert sound chamber attached to a drum head. The system by Millender et all may be helpful in shaping the sound of a bass drum, but does not enable the artful attachment of microphones. The presently disclosed embodiments have been configured to attach to the Millender system and other KickPort type inserts.

Figure 18:
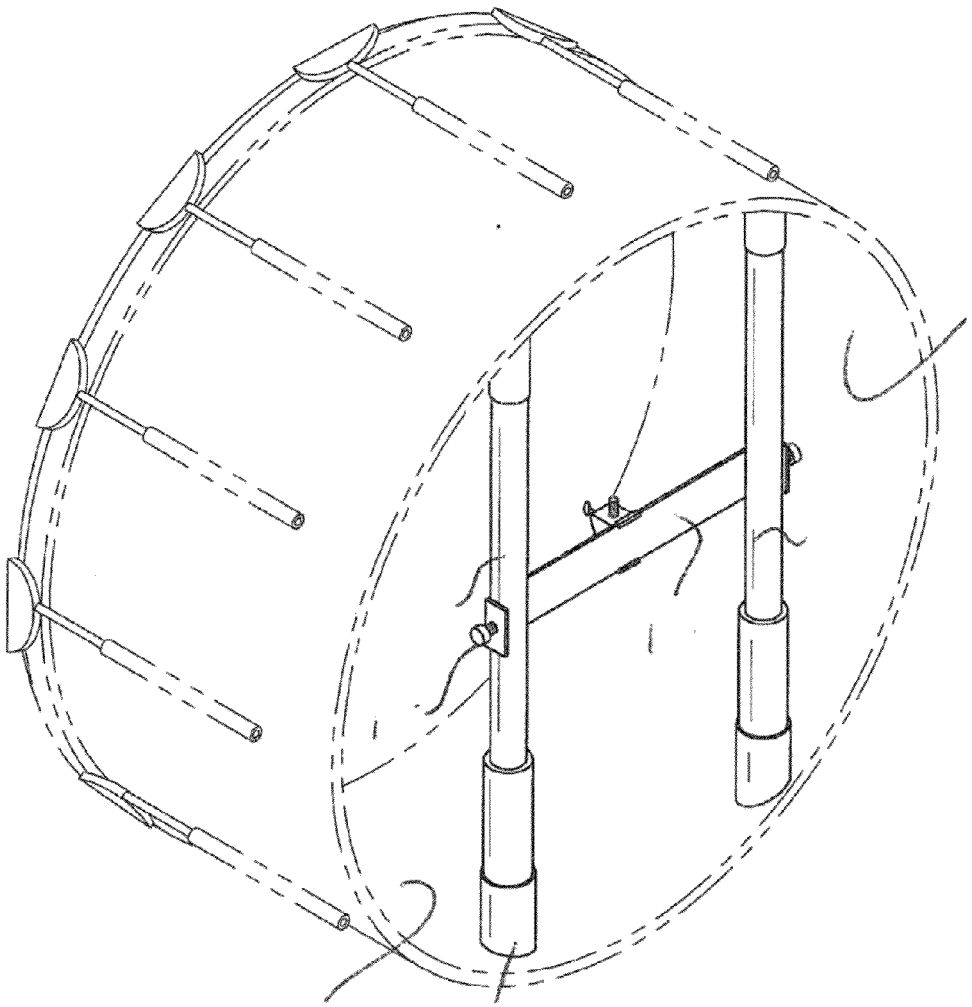
Fig. 18 Prior Art
FIG. 18 depicts an internal microphone system of the prior art

FIG. 18 depicts a support bar system disclosed in the Wells patent. The bulk of the Wells system is known to distort or otherwise change the tonal qualities of base drums.

Figure 19:
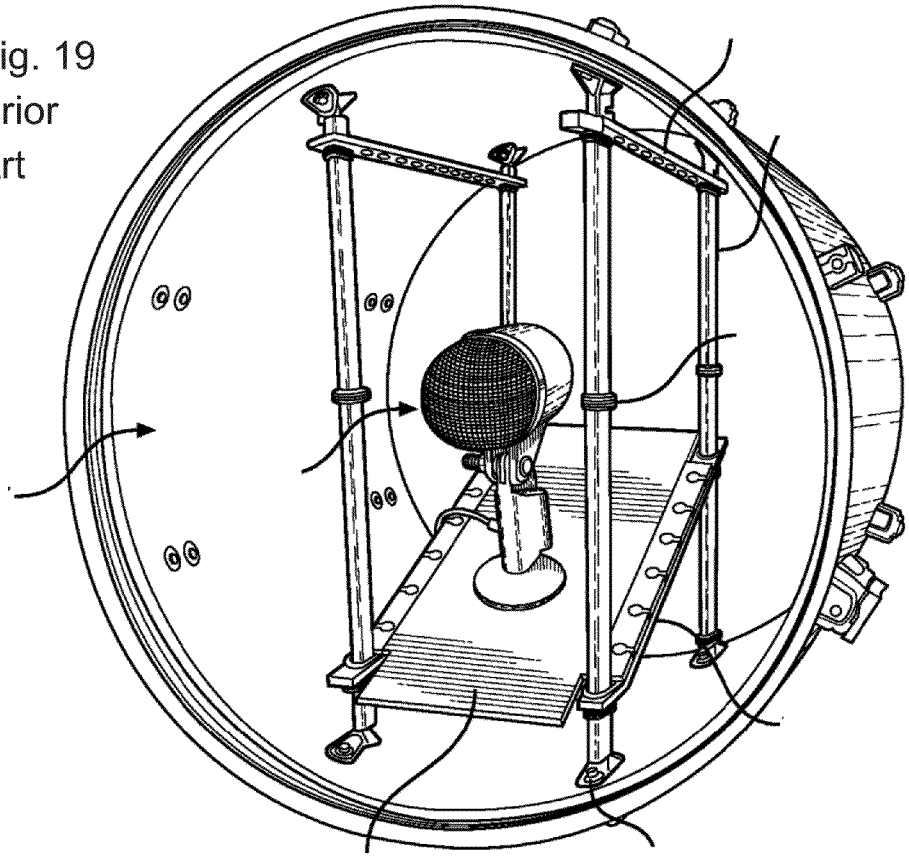
FIG. 19 depicts an internal microphone support system of the prior art

FIG. 19 depicts a trampoline type support structure disclosed in the Mollick patent discussed above.

Figure 20:
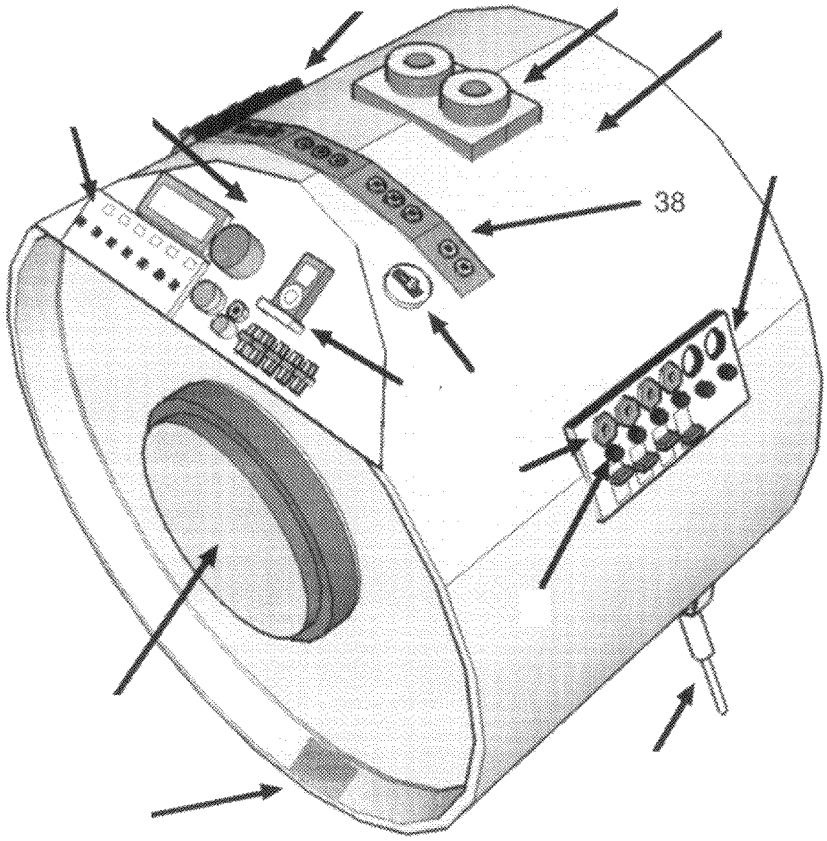
Fig. 20 Prior Art
FIG. 20 depicts an electric bass drum system of the prior art

FIG. 20 depicts an electric bass drum system disclosed in the Steele patent discussed above.

Figure 21:
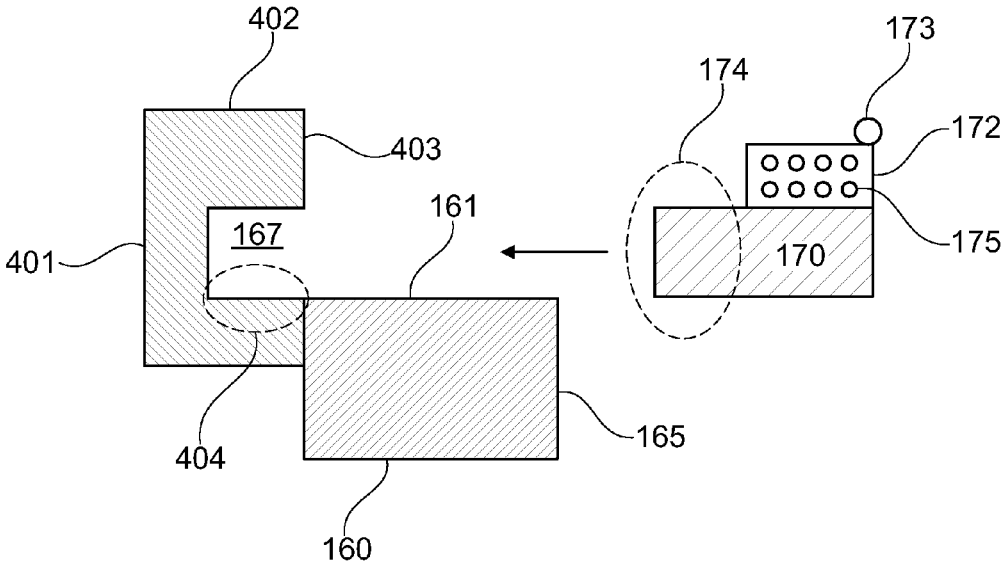
FIG. 21 depicts an expanded sectional view a slide bracket and attachment ring

FIG. 21 depicts further embodiments of a shelf bracket 160, attachment ring 170 and foam member 172. On the right hand side, an attachment ring 170 is shown in secured to a foam member 172. The top side 176 of the foam member is sometimes glued or otherwise attached to a drum head. The attachment ring is shown with an outer perimeter side not attached to the foam member. This area is an insertion portion 174 of the attachment ring. The insertion portion 174 may be used to mate into the containment pocket 167 of the slide bracket. A directional arrow shows the insertion portion moving toward the containment pocket.

The slide bracket 160 may comprise a inner circumference wall 165, a shelf 161, a containment pocket 167, the containment pocket defined by a inner floor 404 vertical outer wall 401, top wall 402 and top face 403.

An O ring 173 may be used in a variety of positions.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Disclosed embodiments also include the following items

Item 1. A microphone system comprising:

a) a foam member 172 having a bottom surface, the bottom surface in attachment to an upper surface of an attachment ring 170, the attachment ring having sufficient width such that a portion of upper surface of the attachment ring is without the foam member, the section of the attachment ring without the foam member referred to as an insertion portion 174 of the attachment ring;

b) a slide bracket comprising an inner circumference wall 165, a shelf 161, the shelf comprising an inner floor area 404, the inner floor area attached to a vertical outer wall, the vertical outer wall attached to a top wall and the top wall attached to a top face 403.

Item 2. The system of item 1 further comprising a containment pocket defined by the inner floor area 404, vertical outer wall, the top wall and the top face.

Item 3. The system of item 1 wherein the slide bracket defines a void 164 suitable to accept a flexible goose neck 200.

Item 4. The system of Item 3 with a flexible goose neck 200 mated into the void 164.

Item 5. The system of item 4 with the flexible goose neck having a first end attached to a microphone clip and a second end attached to a microphone clip.

Item 6. The system of Item 1 further comprising the slide ring in attachment to a mesh screen, foam spacer, speaker frame, and speaker cover.

Item 7. The system of item 6 further comprising a speaker cone made of hemp and a neodymium magnet.

Item 8. The system of item 7 wherein the slide bracket defines a channel void 162.

Item 9. The system of item 8 wherein the speaker cover defines a plurality of voids 112.

Item 10. A microphone kit comprising:

a) microphone assembly 100 comprising a speaker cover, a speaker frame, a speaker voice coil, spider, a magnet, a speaker cone, a foam spacer 150, a slide bracket 160, an attachment ring 170, and a foam member 172.

Item 11. The kit of item 10 further comprising a flexible goose neck 200 and a microphone clip.

Item 12. The kit of item 11 further comprising an O ring 173.

Item 13. The kit of item 12 wherein the slide bracket defines a channel void 162, the channel void spanning a outer circumference 166 of the slide bracket to an inner circumference 165 of the slide bracket.

Item 14. A method of microphoning a drum using a microphone assembly 100, a slide bracket 160, an attachment ring 170 and a foam member 172.

What is claimed is:

1. A microphone system comprising:

a) a foam member having a bottom surface, the bottom surface in attachment to an upper surface of an attachment ring, the attachment ring having sufficient width such that a portion of upper surface of the attachment ring is without the foam member, the section of the attachment ring without the foam member referred to as an insertion portion of the attachment ring;

b) a slide bracket comprising an inner circumference wall, a shelf connected to the inner circumference wall, the shelf comprising an inner floor area, the inner floor area attached to a vertical outer wall, the vertical outer wall attached to a top wall and the top wall attached to a top face c) the insertion portion of the attachement ring inserted into a containment pocket of the slide bracket, the containment pocket defined within the vertical outer wall of the attachment ring.

2. The system of claim 1 wherein the slide bracket defines a void suitable to accept a flexible goose neck.

3. The system of claim 2 with a flexible goose neck mated into the void of the slide bracket.

4. The system of claim 3 with the flexible goose neck having a first end attached to a first microphone clip and a second end attached to a second microphone clip.

5. The system of claim 1 further comprising the slide bracket in attachment to a mesh screen, foam spacer, speaker frame, and speaker cover.

6. The system of claim 5 further comprising a hemp speaker cone and a neodymium magnet.

7. The system of claim 6 wherein the slide bracket defines a channel void.

8. The system of claim 7 wherein the speaker cover defines a plurality of voids and wherein the foam member and foam spacer are comprised of closed cells.

9. A microphone kit comprising:

a) microphone assembly comprising a speaker cover, a speaker frame, a speaker voice coil, spider, a magnet, a speaker cone, a foam spacer, an attachment ring, and a foam member;

b) a slide bracket, the slide bracket defining a channel void, and the channel void spanning an outer circumference of the slide bracket, the slide bracket further comprising an inner circumference.

10. The kit of claim 9 further comprising a flexible goose neck and a microphone clip.

11. The kit of claim 10 further comprising an O ring.

12. A method of microphoning a drum, the method comprising the steps of:

a) securing an attachment ring to the perimeter of a void within a drum head; the attachment ring comprising, an insertion portion, a foam member and a drum head O ring;

b) securing a slide bracket into the attachment ring; the slide bracket comprising a shelf, channel for XLR (External Line Return) cable, attachment voids, an inner circumference, and outer circumference, and a containment pocket; and c) securing a microphone assembly to the slide bracket.

13. The method of claim 12 including the steps of:

a) using a gooseneck in attachment to the slide bracket; and b) using a microphone clip in attachment to the gooseneck.

14. The method of claim 12 including the step of using an adhesive to secure the foam member to a drum head.

15. The method of claim 14 including the step of using a foam member compromised of closed cells.

* * * * *